US009735526B1

(12) United States Patent
Chen

(10) Patent No.: US 9,735,526 B1
(45) Date of Patent: Aug. 15, 2017

(54) HYBRID SOCKET CONNECTOR INTEGRATED WITH POWER SUPPLY AND SIGNAL TRANSMISSION FUNCTIONS

(71) Applicant: OUPIIN ELECTRONIC (KUNSHAN) CO., LTD., Kunshan, Jiangsu (CN)

(72) Inventor: Hsin Chih Chen, Jiangsu (CN)

(73) Assignee: OUPIIN ELECTRONIC (KUNSHAN) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 15/264,633

(22) Filed: Sep. 14, 2016

(30) Foreign Application Priority Data

Apr. 1, 2016 (CN) ..... 2016 1 0198432

(51) Int. Cl.

| | |
|---|---|
| ***H01R 24/00*** | (2011.01) |
| ***H01R 27/02*** | (2006.01) |
| ***H01R 13/11*** | (2006.01) |
| ***H01R 13/436*** | (2006.01) |

(52) U.S. Cl.
CPC ..... *H01R 27/02* (2013.01); *H01R 13/11* (2013.01); *H01R 13/436* (2013.01)

(58) Field of Classification Search
CPC ..... H05K 1/0201; H05K 7/20154; H01R 9/2491; H01R 13/6273; H01R 24/66; H01R 13/631
USPC ..... 439/638, 485, 626
See application file for complete search history.

(56) References Cited

U.S. PATENT DOCUMENTS

| | | | | |
|---|---|---|---|---|
| 7,666,025 | B2 * | 2/2010 | Cheng | H01R 12/7088 439/374 |
| 8,702,445 | B2 * | 4/2014 | Yu | H01R 13/46 439/485 |
| 9,455,512 | B2 * | 9/2016 | Chen | H01R 12/724 |
| 2014/0127945 | A1 * | 5/2014 | Yu | H01R 13/428 439/626 |
| 2016/0079704 | A1 * | 3/2016 | Chen | H01R 13/631 439/374 |

* cited by examiner

*Primary Examiner* — Hae Moon Hyeon
(74) *Attorney, Agent, or Firm* — Soroker Agmon Nordman

(57) ABSTRACT

A hybrid socket connector is disclosed in this invention. The hybrid socket connector includes a receptacle housing having a signal receptacle part and a power receptacle part, a row of signal terminal assemblies mounted on the signal receptacle part, a row of power terminals mounted on the power receptacle part, and at least one tie bar mounted on the power receptacle part to retain these power terminals. Each signal port is generally Z-shaped. Each signal terminal has a first elastic arm and a second elastic arm located below the first elastic arm. The first and second elastic arms are staggered along a left-right direction. The hybrid socket connector of the invention can integrate the power supply with the signal transmission to ensure the safety of its structure and improve the electrical performance thereof.

10 Claims, 15 Drawing Sheets

HYBRID SOCKET CONNECTOR INTEGRATED WITH POWER SUPPLY AND SIGNAL TRANSMISSION FUNCTIONS

BACKGROUND OF THE INVENTION

1. Field of the Invention

The present invention relates to a connector technology, and more particularly to a hybrid socket connector with power supply and signal transmission functions.

2. Description of the Prior Art

In the present market, it has a demand for a high current connector, and it hopes that the high current connector can make power and signal be integrated together to provide a current of 260 amp per inch linear space, and an integrity of power and signal is also indispensable.

Hence, it is needed to provide a hybrid socket connector with power supply and signal transmission functions for satisfying the market demand for large current and small space of the electrical connector.

BRIEF SUMMARY OF THE INVENTION

An object of the present invention is to provide a hybrid socket connector, in which power supply and signal transmission functions are integrated together and can ensure integrity of the power supply and the signal transmission, and which has a strong structural stability and can improve the electrical connection performance.

Other objects and advantages of the present invention may be further understood from the technical features disclosed by the present invention.

To achieve the aforementioned object or other objects of the present invention, the present invention adopts the following technical solution.

The present invention provides a hybrid socket connector, which comprises a receptacle housing, a row of signal terminal assemblies, a row of power terminals and at least one tie bar. The receptacle housing includes a signal receptacle part and a power receptacle part adjacent to the signal receptacle part. The signal receptacle part has a lot of signal ports located in the front of the signal receptacle part and arranged in multi-rows and multi-columns pattern, and a row of signal terminal-receiving passages located on the rear thereof and communicated with the corresponding signal ports. Each signal port has a signal insertion hole located in the middle of the signal port, a first opening located in the upper left thereof, and a second opening located in the lower right thereof. The power receptacle part has a row of power ports located on the front of the power receptacle part, a row of power terminal-receiving passages located on the rear thereof and communicated with the corresponding power ports, and a long slot located on the top thereof and communicated with these power terminal-receiving passages. The row of signal terminal assemblies are mounted in the signal receptacle part. Each signal terminal assembly includes an insulative frame and multiple signal terminals supported by the insulative frame. Each signal terminal has at least one pair of elastic arms extending out of the front of the insulative frame, and a signal tail extending out of the bottom of the insulative frame. The pair of elastic arms consists of a first elastic arm and a second elastic arm located below the first elastic arm. The first elastic arm and the second elastic arm are arranged in a staggered manner along a left-right direction. The first elastic arm forms a first signal contact surface on the right of the first elastic arm. The second elastic arm forms a second signal contact surface on the left of the second elastic arm. The insulative frame is retained in the corresponding signal terminal-receiving passage. The front of the first elastic arm enters into the first opening of the signal port and the first signal contact surface is exposed in the signal insertion hole. The front of the second elastic arm enters into the second opening of the signal port and the second signal contact surface is exposed in the signal insertion hole. The signal tail extends out of the bottom of the signal receptacle part. The row of power terminals are mounted in the corresponding power terminal-receiving passages of the power receptacle part and entering into the corresponding power ports. The tie bar is mounted in the long slot of the power receptacle part for retaining these power terminals.

In one embodiment, the signal port is Z-shaped; the signal port further includes a first vertical wall separating the first opening from the signal insertion hole, and a second vertical wall separating the second opening from the signal insertion hole; and the first vertical wall and the second vertical wall are disposed on the front of the signal port.

In one embodiment, the signal receptacle part further includes a row of retaining holes located on the top thereof and communicated with the corresponding signal terminal-receiving passages; the insulative flame has a cut formed on the top thereof and a cantilever beam located in the cut and extending backward from a front wall of the cut; the cantilever beam forms a protrusion protruding upward on the end of the cantilever beam; when the insulative frame is retained in the corresponding signal terminal-receiving passage, the cantilever beam and the protrusion enter into the retaining hole.

In one embodiment, each power port includes a power insertion hole located in the middle of the power port, and at least two long channels symmetrically arranged on two sides of the power insertion hole and communicated with the power insertion hole.

In one embodiment, the row of power terminals include multiple pairs of power terminals; each pair of power terminals consist of two adjacent and symmetrical power terminals; each pair of power terminals include a first vertical plate, a second vertical plate being parallel to and being separated from the first vertical plate, at least one first flexible arm extending forward from the front of the first vertical plate, at least one second flexible arm extending forward from the front of the second vertical plate and being symmetrical to the first flexible arm, at least one first convex surface facing the second flexible arm and being formed on the first flexible arm by bending, at least one second convex surface facing the first flexible arm and being formed on the second flexible arm by bending, multiple first power tails being formed on the bottom of the first vertical plate, and multiple second power tails being formed on the bottom of the first vertical plate; the first flexible arm and the second flexible arm together construct a clamp shape; when the pair of power terminals are mounted in the power receptacle part, the first and second vertical plates are retained in the corresponding power terminal-receiving passage, the fronts of the first and second flexible arms enter into the corresponding long channels of the power port, and the first and second convex surfaces are exposed in the power insertion hole.

In one embodiment, the first vertical plate has a first protruding portion formed thereon and protruding toward the second vertical plate; the second vertical plate has a second protruding portion formed thereon and protruding toward the first vertical plate; the second protruding portion is symmetrical to the first protruding portion; when the pair of power terminals are mounted in the power receptacle part, the first protruding portion and the second protruding portion are mechanically connected together and contact each other to together form a bridge connecting the first vertical plate and the second vertical plate.

In one embodiment, the first vertical plate further has a first recess formed on the top of the first vertical plate, and the second vertical plate further has a second recess formed on the top of the second vertical plate and being symmetrical to the first recess; when the pair of power terminals are mounted in the power receptacle part, the first and second recesses are aligned with the long slot to together accommodate the tie bar.

In one embodiment, the long slot forms an anti-mistake recess located on one sidewall of the long slot, and multiple short vertical arms located on the other sidewall thereof and being corresponding to these terminal-receiving passages; the tie bar has an anti-mistake bump located on the front of the tie bar and multiple locks located on the rear thereof; when the tie bar is embedded into the long slot and enters into the first and second recesses, the anti-mistake bump is engaged with the anti-mistake recess, and these locks are engaged with the bottoms of the corresponding vertical arms.

In one embodiment, the first vertical plate further has a first holding portion formed on the bottom thereof and protruding toward the second vertical plate, and the second vertical plate further has a second holding portion formed on the bottom thereof and protruding toward the first vertical plate; when the pair of power terminals are mounted in the power receptacle part, the first holding portion and the second holding portion are pressed onto inner walls of the power terminal-receiving passage.

In one embodiment, the receptacle housing has two power receptacle parts, which are located on two sides of the signal receptacle part respectively; the row of signal terminal assemblies is located in the middle of the row of power terminals; the hybrid socket connector includes two tie bars; each power port has six long channels symmetrically distributed on the two sides thereof; and each pair of power terminals includes three first flexible arms and three second flexible arms.

In comparison with the prior art, the hybrid socket connector of the present invention can make power supply and signal transmission functions be integrated together for ensuring integrity of the power supply and the signal transmission. Moreover, the hybrid socket connector of the present invention can be reliably connected with the plug connector and has a strong structural stability by modifying the structures of the power terminals and the signal terminals.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
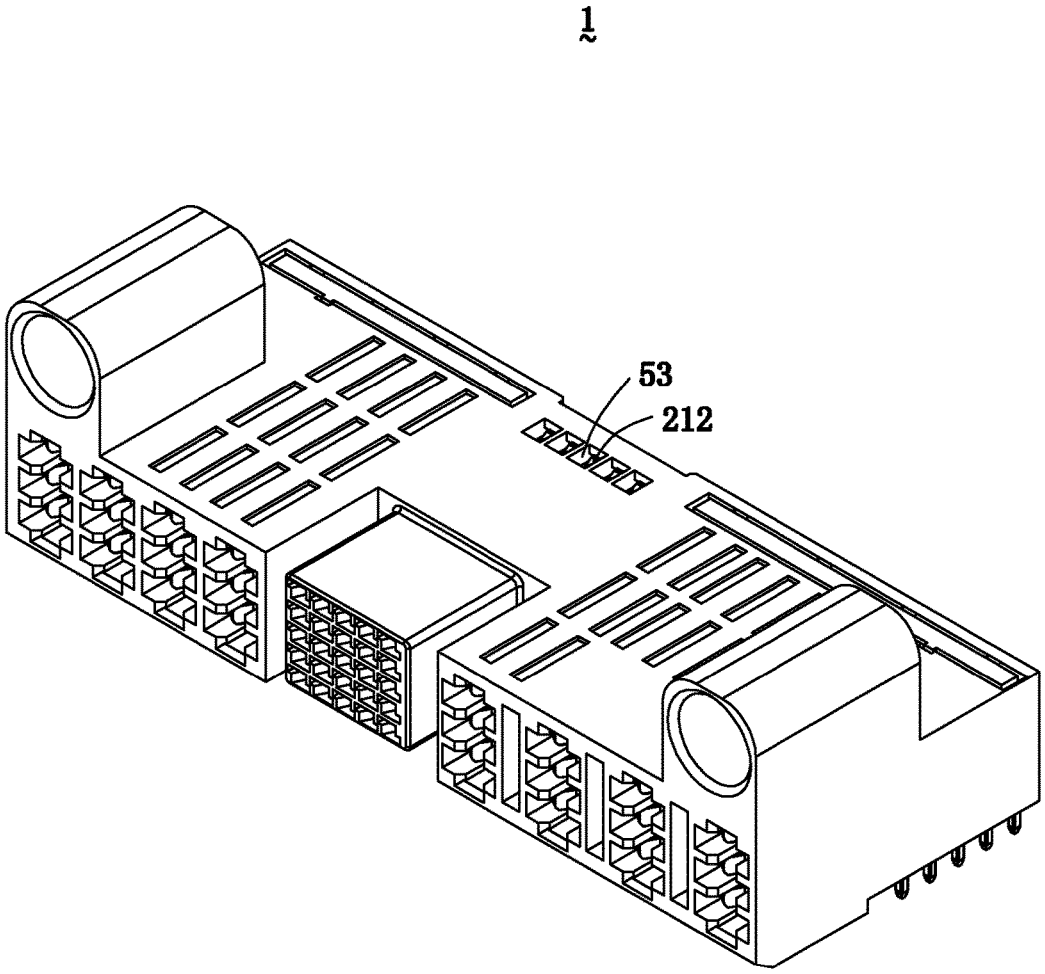
FIG. 1 is a perspective schematic view of a hybrid socket connector of the present invention.
Figure 2:
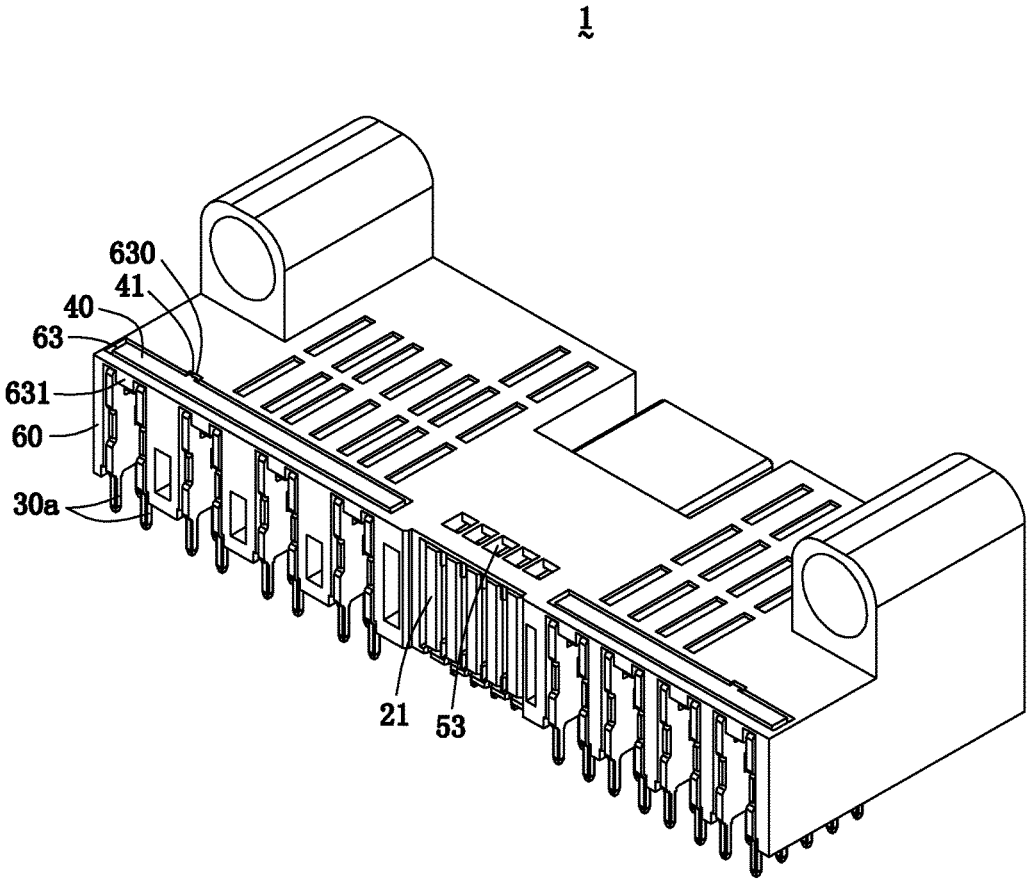
FIG. 2 is a perspective schematic view of the hybrid socket connector along another direction.

Please refer to FIGS. 1 and 2, a hybrid socket connector 1 of the present invention is a horizontal socket connector, the mating direction of which is parallel to a circuit board (not shown).

Figure 3:
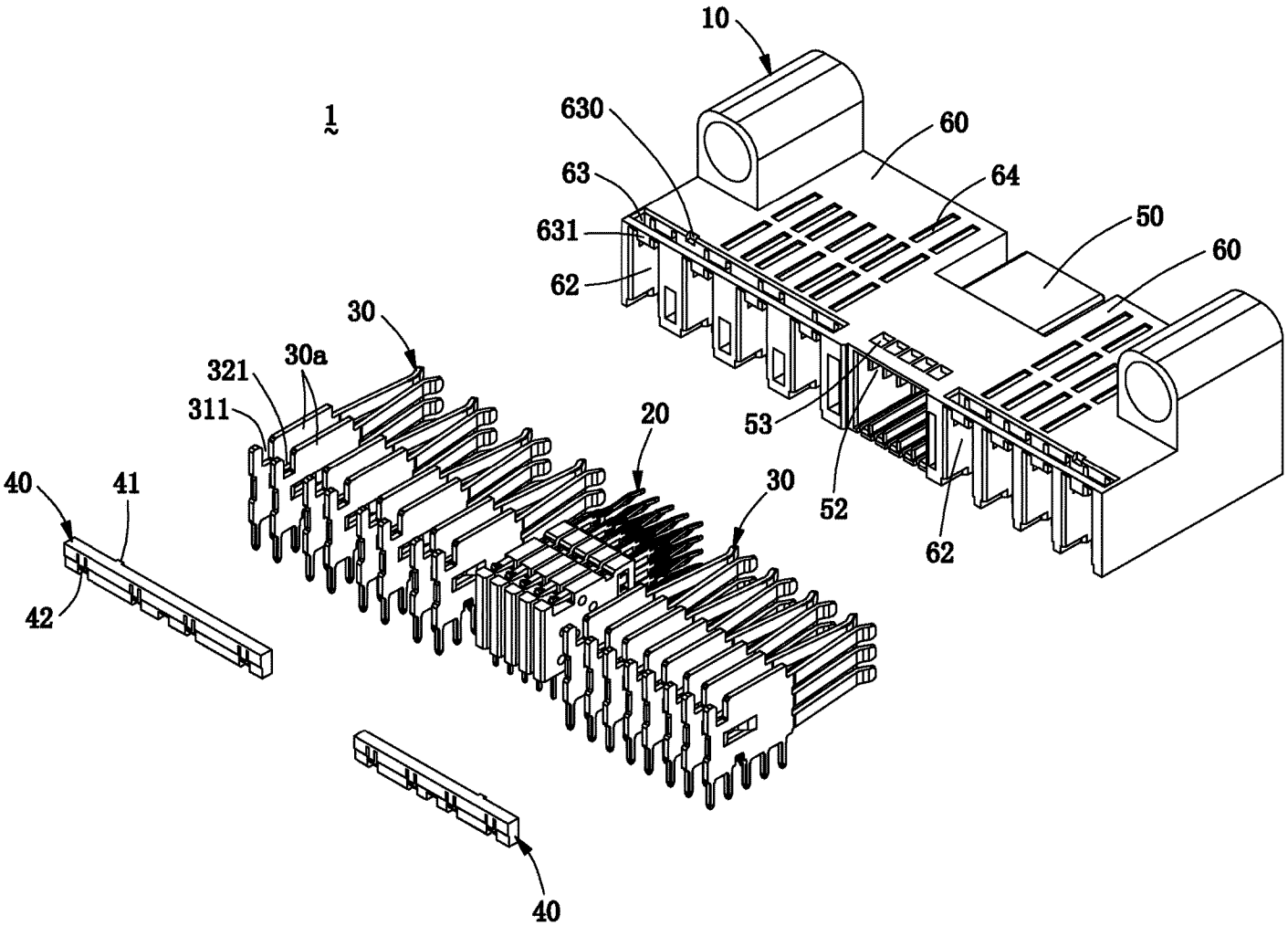
FIG. 3 is an exploded view of the hybrid socket connector shown in FIG. 2.
Figure 4:
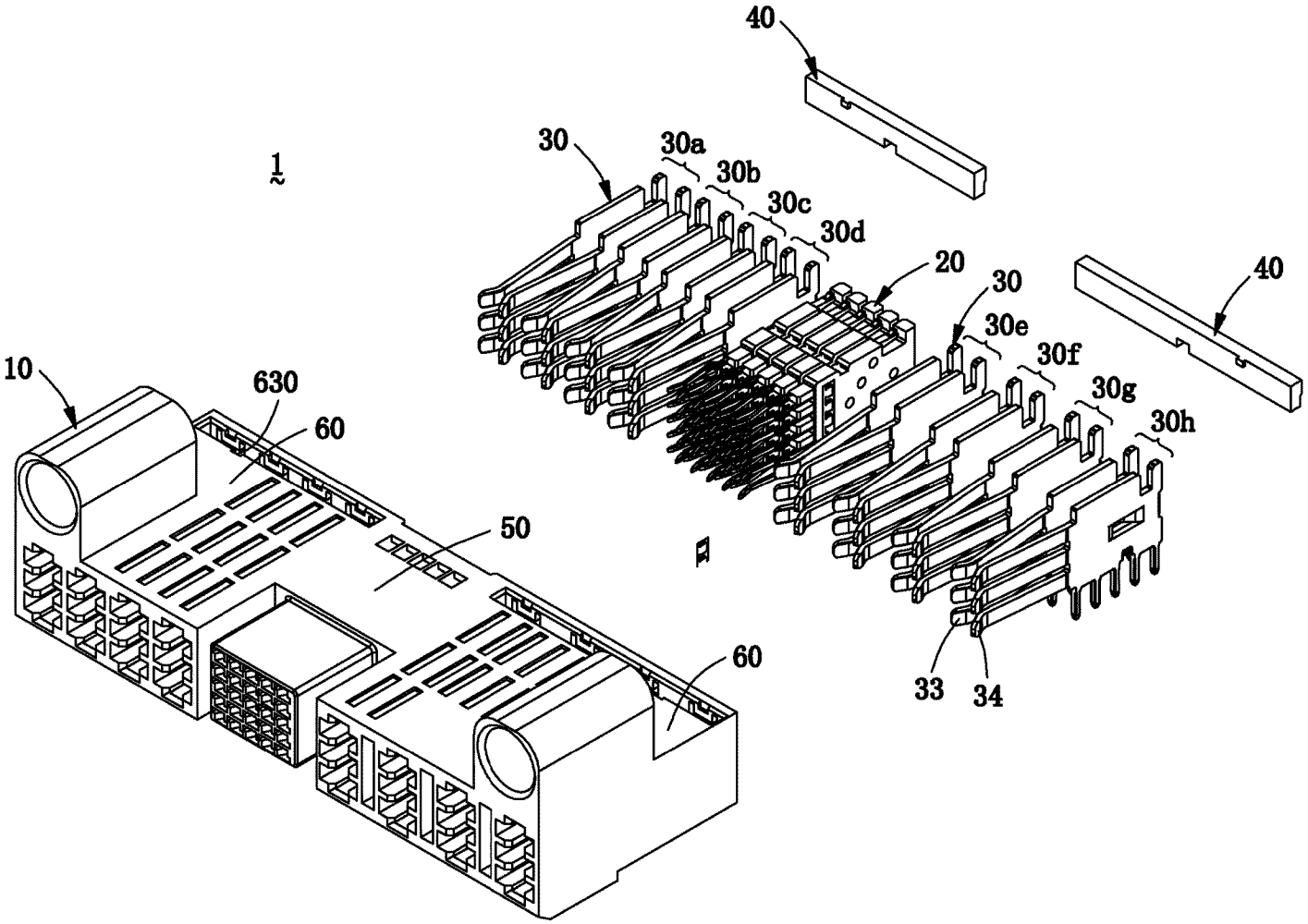
FIG. 4 is an exploded view of the hybrid socket connector shown in FIG. 1.

Please refer to FIGS. 3 and 4, the hybrid socket connector 1 of the present invention includes a receptacle housing 10, a row of signal terminal assemblies 20 mounted in the receptacle housing 10, a row of power terminals 30 mounted in the receptacle housing 10, and at least one tie bar 40 used to fix these power terminals 30. In the embodiment, the row of signal terminal assemblies 20 is located in the middle of the row of power terminals 30. Namely, the row of the power terminals 30 are separated from the middle thereof to be two sections. In the embodiment, the hybrid socket connector 1 of the present invention includes two tie bars 40 for fixing the two sections of the separated power terminals 30.

Please refer to FIGS. 3 and 4, the receptacle housing 10 has a signal receptacle part 50 and a power receptacle part 60 adjacent to the signal receptacle part 50. In this embodiment, the receptacle housing 10 has two power receptacle parts 60, which are located on two sides of the signal receptacle part 50 respectively. Moreover, the signal receptacle part 50 and the two power receptacle parts 60 share a front surface of the receptacle housing 10; the signal receptacle part 50 and the two power receptacle parts 60 share a rear surface of the receptacle housing 10; the signal receptacle part 50 and the two power receptacle parts 60 share a bottom surface of the receptacle housing 10; and the signal receptacle part 50 and the two power receptacle parts 60 share a top surface of the receptacle housing 10.

Figure 5:
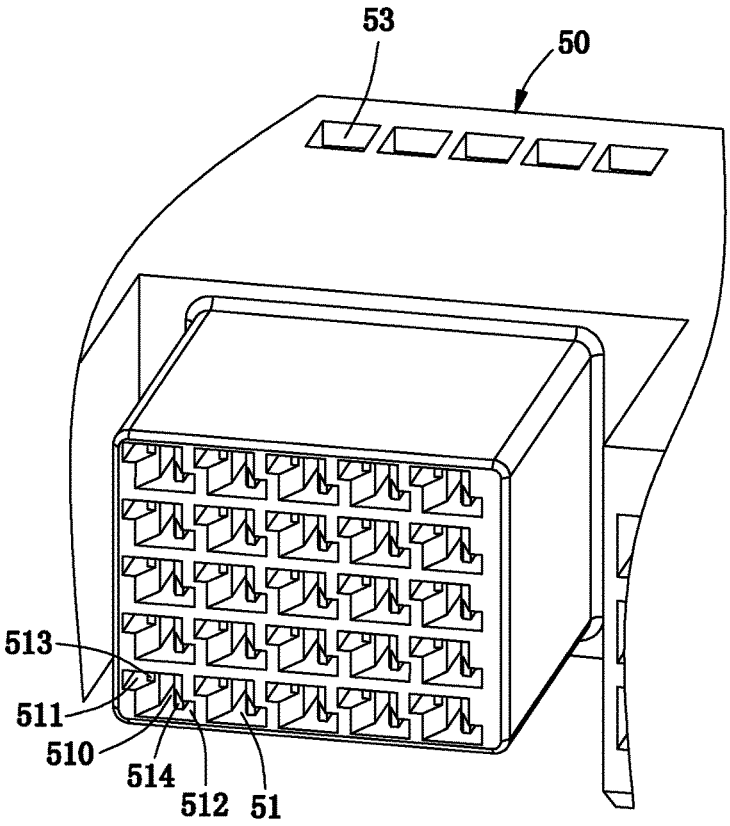
FIG. 5 is an enlarged view of a signal receptacle part of the present invention.

Please refer to FIG. 5, the signal receptacle part 50 forms a lot of signal ports 51 located in the front of the signal receptacle part 50 and arranged in multi-rows and multi-columns pattern, and a row of signal terminal-receiving passages 52 (label seen in FIG. 3) located on the rear thereof and communicated with the corresponding signal ports 51. Each signal port 51 is generally Z-shaped. The signal port 51 includes a signal insertion hole 510 located in the middle of the signal port 51, a first opening 511 located in the upper left thereof, and a second opening 512 located in the lower right thereof. In the embodiment, the signal port 51 further includes a first vertical wall 513 separating the first opening 511 from the signal insertion hole 510, and a second vertical wall 514 separating the second opening 512 from the signal insertion hole 510. It is noted that the first vertical wall 513 and the second vertical wall 514 are only disposed on the front of the signal port 51 to be used to provide the separation function. In the rear of the signal port 51, there are no any vertical walls, so the first opening 511, the second opening 512 and the signal port 51 are connected together. As shown in FIGS. 3 and 5, the signal receptacle part 50 further includes a row of retaining holes 53 located on the top thereof and communicated with the corresponding signal terminal-receiving passages 52. In the embodiment, these retaining holes 53 are oblong.

Figure 6:
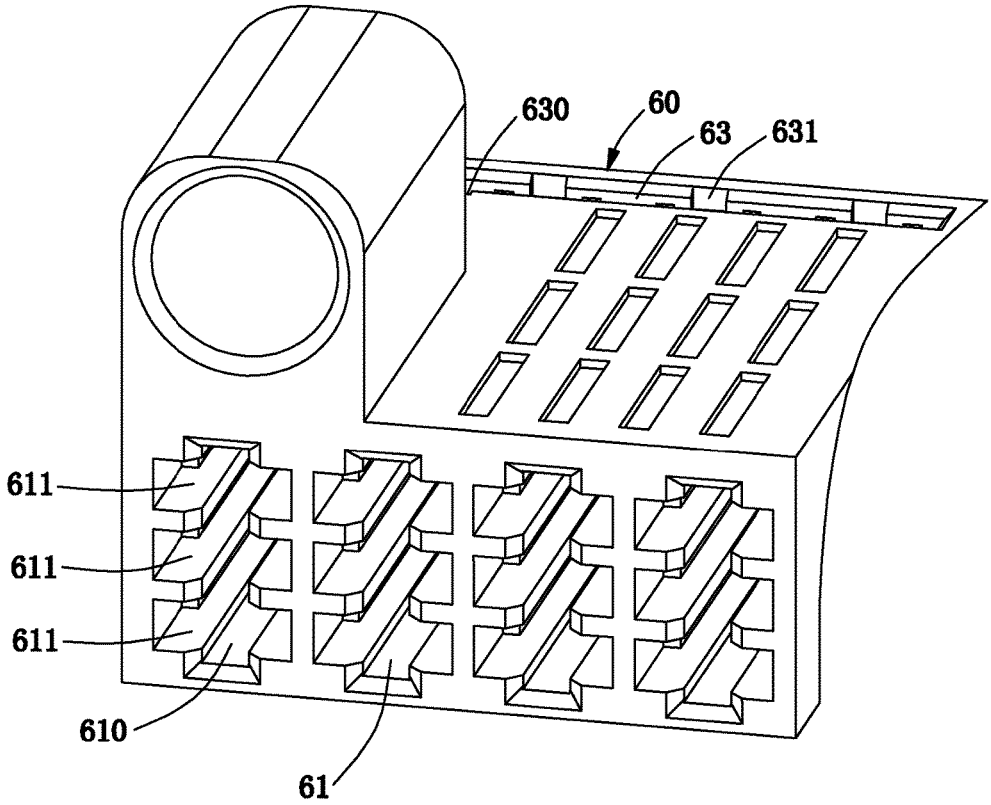
FIG. 6 is an enlarged view of a power receptacle part of the present invention.

Please refer to FIG. 6, the power receptacle part 60 forms a row of power ports 61 located on the front of the power receptacle part 60, and a row of power terminal-receiving passages 62 (label seen in FIG. 3) located on the rear thereof and communicated with the corresponding power ports 61. Each power port 61 includes a power insertion hole 610 located in the middle of the power port 61, and at least two long channels 611 symmetrically arranged on two sides of the power insertion hole 610 and communicated with the power insertion hole 610. In the embodiment, each power port 61 has six long channels 611 symmetrically distributed on the two sides thereof. The power receptacle part 60 further includes a long slot 63 located on the top thereof and communicated with these power terminal-receiving passages 62. The long slot 63 forms an anti-mistake recess 630 (label seen in FIG. 3) located on one sidewall of the long slot 63, and multiple short vertical arms 631 (label also seen in FIG. 3) located on the other sidewall thereof and being corresponding to these terminal-receiving passages 62.

In the embodiment, these signal ports 51 and these power ports 61 are surrounded by a closed form, but these signal terminal-receiving passages 52 and these power terminal-receiving passages 62 all have an open bottom, which terminal tails can pass through for being mounted on an outside circuit board. Furthermore, as shown in FIG. 3, the receptacle housing 10 further has multiple narrow holes 64 on the top thereof, which are communicated with some power terminal-receiving passages 62 for dissipating the heat.

Figure 7:
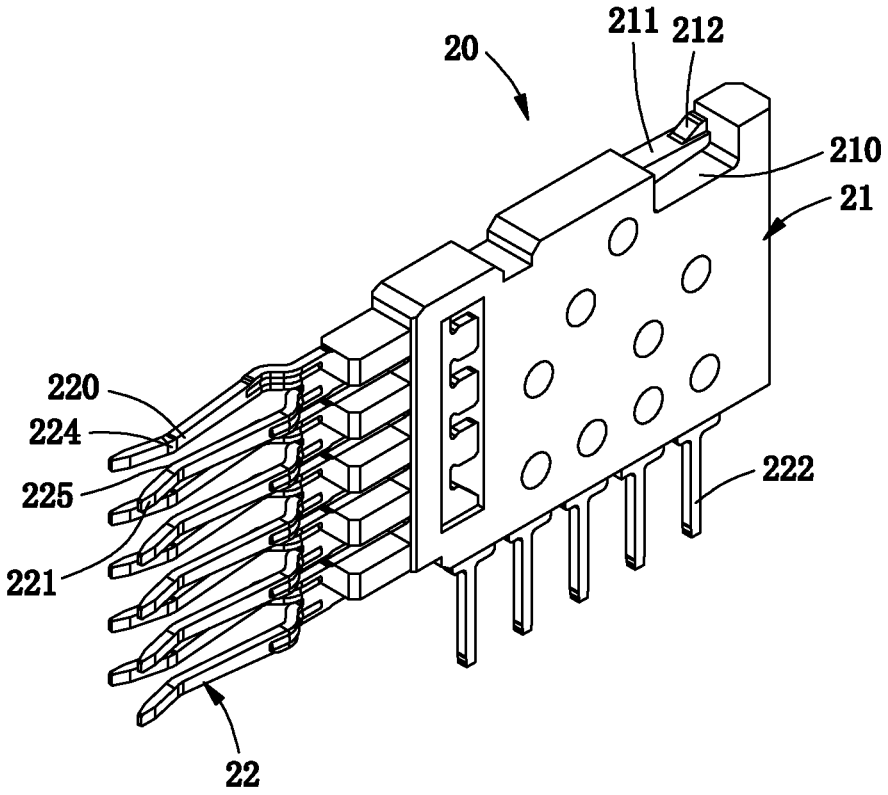
FIG. 7 is a perspective schematic view of one signal terminal assembly of the hybrid socket connector of the present invention.

Please refer to FIG. 7, each signal terminal assembly 20 includes an insulative frame 21 and multiple signal terminals 22 supported by the insulative frame 21. Each signal terminal 22 at least having at least one pair of elastic arms 220, 221 extending out of the front of the insulative frame 21, and a signal tail 222 extending out of the bottom of the insulative frame 21. The pair of elastic arms 220, 221 consist of a first elastic arm 220 and a second elastic arm 221 located below the first elastic arm 220. The first elastic arm 220 and the second elastic arm 221 are arranged in a staggered manner along a left-right direction, and respectively form a first signal contact surface 224 on the right of the first elastic arm 220 and a second signal contact surface 225 on the left of the second elastic arm 221. Namely, the first elastic arm 220 and the second elastic arm 221 are not located on a same vertical plane, and they form staggered structures by bending twice along the opposite directions. In the embodiment, the elastic arms 220, 221 and the signal tail 222 of each signal terminal 22 are connected by a conductive plate (not shown), which is covered by the insulative frame 21. The signal tail 222 is pin-typed. Moreover, the insulative frame 21 has a cut 210 formed on the top thereof and a cantilever beam 211 located in the cut 210 and extending backward from a front wall of the cut 210. The cantilever beam 211 forms a protrusion 212 protruding upward on the end thereof. Furthermore, the elastic arms 220, 221 of these signal terminal assemblies 20 are arranged in multi-rows and multi-columns pattern for being corresponding to these signal ports 51 shown in FIG. 5.

Please refer to FIGS. 10, 12, 14 and 15, when the signal terminal assembly 20 is mounted in the signal receptacle part 50, the front of the first elastic arm 220 of each signal terminal 22 (label seen in FIG. 7) enters into the first opening 511 of the signal port 51 and the first signal contact surface 224 is exposed in the signal insertion hole 510. The front of the second elastic arm 221 of each signal terminal 22 enters into the second opening 512 of the signal port 51 and the second signal contact surface 225 is exposed in the signal insertion hole 510. The signal tail 222 of each signal terminal 22 extends out of the bottom of the signal receptacle part 50 to be ready for the connection to the outside circuit board. The insulative frame 21 is retained in the corresponding signal terminal-receiving passage 52. When a plug terminal of a plug connector (not shown) is inserted from the signal port 51 into the signal insertion hole 510, different parts of the plug terminal can electrically contact with the first signal contact surface 224 and the second signal contact surface 225, thereby forming a reliable electrical path. Further, as shown in FIGS. 1, 2 and 7, the cut 210 of the insulative frame 21 is just aligned with the corresponding retaining hole 53 of the signal receptacle part 50, the cantilever beam 211 and the protrusion 212 enter into the retaining hole 53, and the protrusion 212 can prevent the insulative frame 21 from retreating from the receptacle housing 10.

Please refer to FIG. 4, this row of power terminals 30 include multiple pairs of power terminals. Each pair of power terminals consist of two adjacent and symmetrical power terminals. In the embodiment, this row power terminals 30 include eight pairs of power terminals **30*a*-30*h*. The following text will take one pair of power terminals 30*a*** as an example for detail description.

Figure 8:
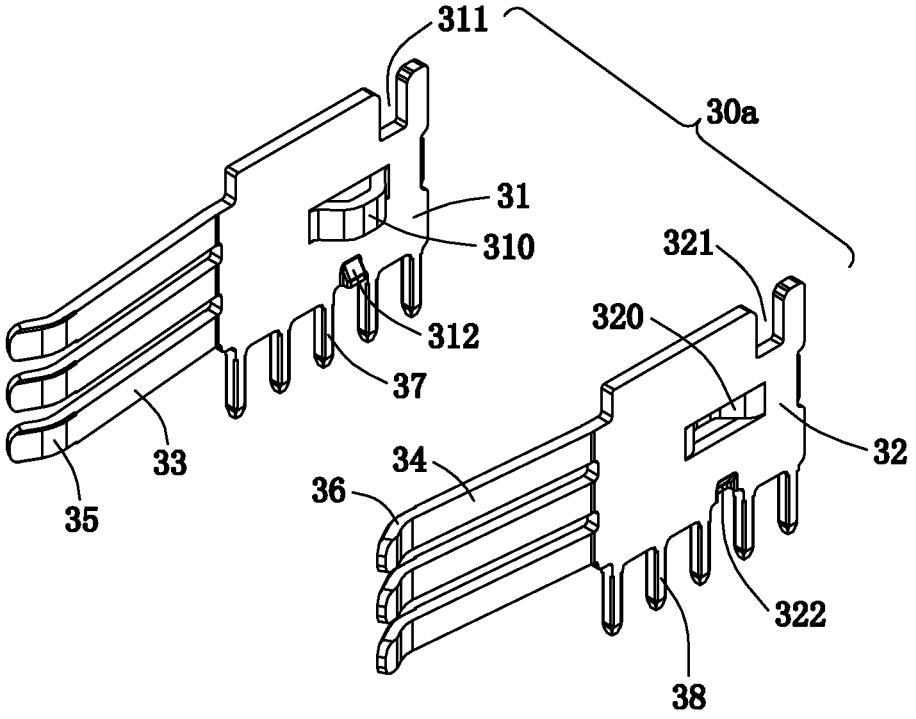
FIG. 8 is a perspective schematic view of one pair of power terminals of the hybrid socket connector of the present invention, wherein the pair of power terminals are separated for clearly showing their detail structures.

Please refer to FIG. 8, the pair of power terminals **30*a* include a first vertical plate 31, a second vertical plate 32 being parallel to and being separated from the first vertical plate 31, at least one first flexible arm 33 extending forward from the front of the first vertical plate 31, at least one second flexible arm 34 extending forward from the front of the second vertical plate 32 and being symmetrical to the first flexible arm 33, at least one first convex surface 35 being formed on the first flexible arm 33 by bending and facing the second flexible arm 34, at least one second convex surface 36 being formed on the second flexible arm 34 by bending and facing the first flexible arm 33, multiple first power tails 37 being formed on the bottom of the first vertical plate 31, and multiple second power tails 38 being formed on the bottom of the first vertical plate 32**.

Please refer to FIG. 8, the first vertical plate 31 has a first protruding portion 310 formed thereon and protruding toward the second vertical plate 32. The second vertical plate 32 has a second protruding portion 320 formed thereon and protruding toward the first vertical plate 31. The second protruding portion 320 is symmetrical to the first protruding portion 310. The first protruding portion 310 and the second protruding portion 320 are mechanically connected together and contact each other, so the pair of power terminals 30*a* can form an electrical integrated whole. Furthermore, the first vertical plate 31 further has a first recess 311 formed on the top of the first vertical plate 31 and a first holding portion 312 formed on the bottom thereof and protruding toward the second vertical plate 32. The second vertical plate 32 further has a second recess 321 on the top of the second vertical plate 32 and a second holding portion 322 formed on the bottom thereof and protruding toward the first vertical plate 31.

Please refer to FIG. 4, the first flexible arm 33 and the second flexible arm 34 together construct a clamp shape. As shown in FIG. 7, the first convex surface 35 and the second convex surface 36 are closest to each other, so that the first flexible arm 33 and the second flexible arm 34 construct the clamp shape on the position of the first convex surface 35 and the second convex surface 36. In the embodiment, each pair of power terminals 30*a*-30*h* includes three first flexible arms 33 and three second flexible arms 34. These first power tails 37 and these second power tails 38 are pin-typed and respectively extend downward from the bottoms of the first vertical plate 31 and the second vertical plate 32.

Figure 11:
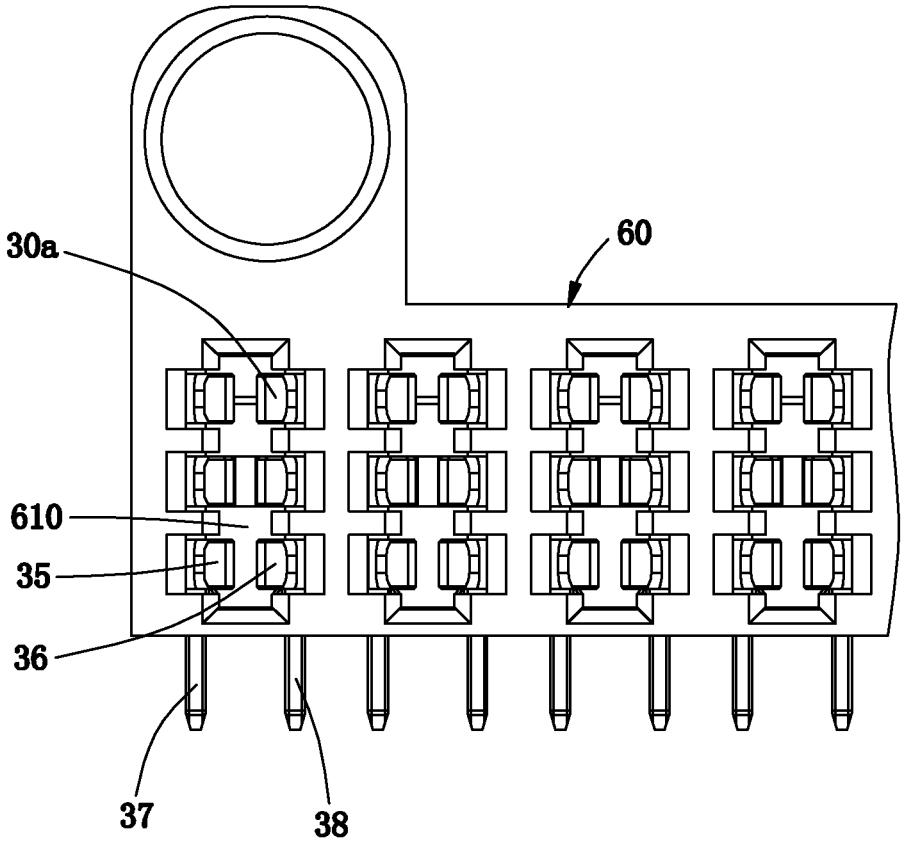
FIG. 11 is a plan view of power ports of the hybrid socket connector of the present invention.
Figure 12:
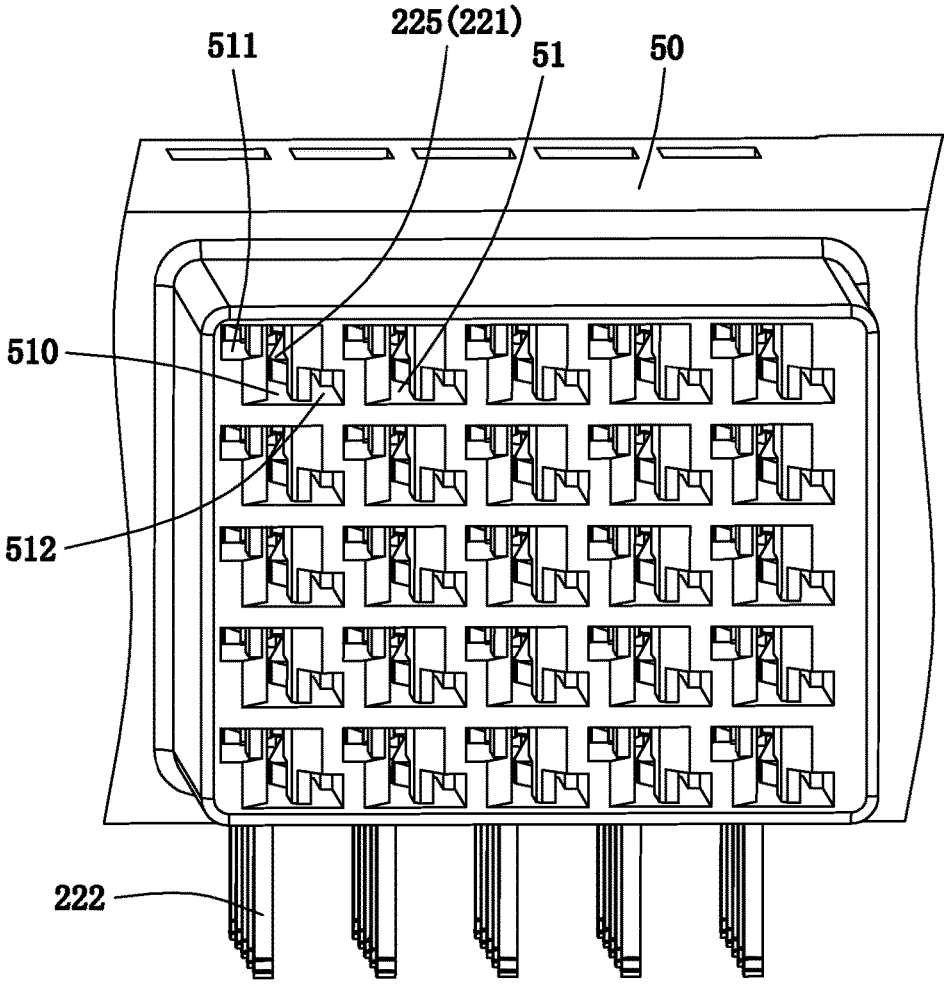
FIG. 12 is a schematic view of a partial structure of the hybrid socket connector, which mainly shows a location relation of signal terminals and the signal receptacle part.
Figure 13:
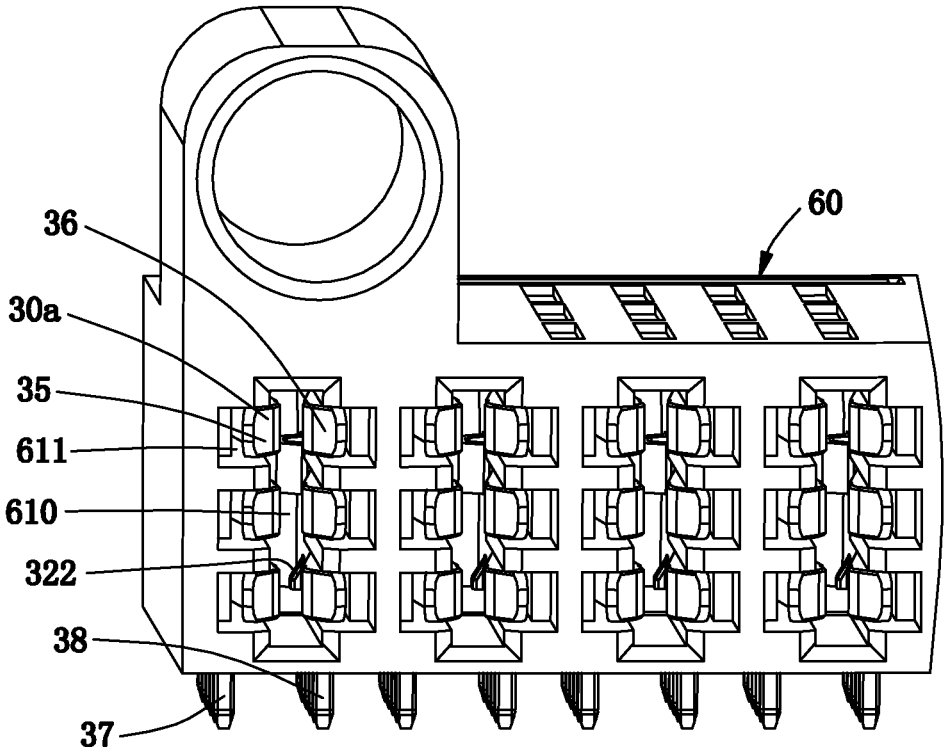
FIG. 13 is a schematic view of a partial structure of the hybrid socket connector, which mainly shows a location relation of the power terminals and the power receptacle part.
Figure 14:
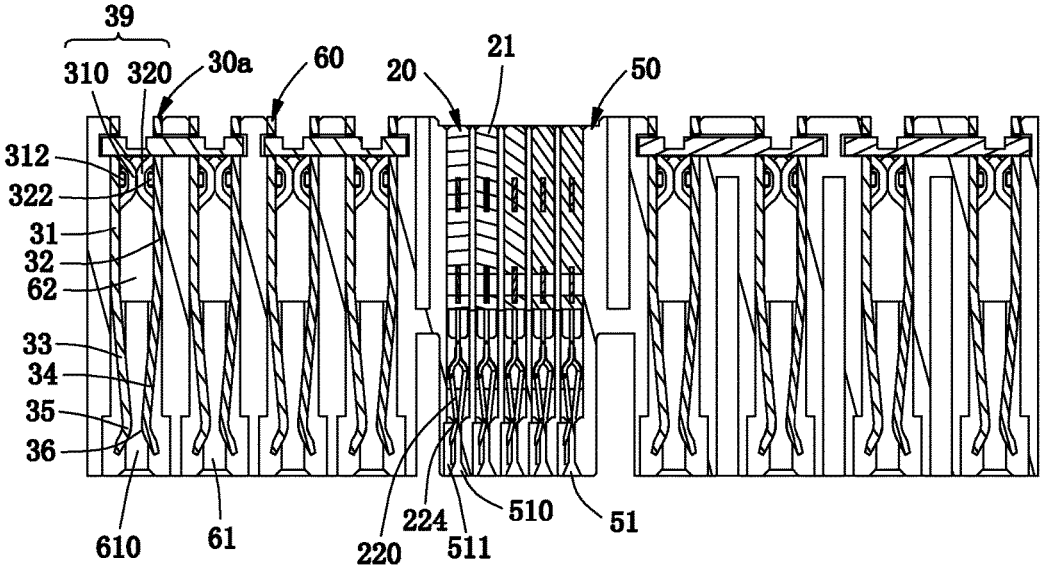
FIG. 14 is a sectional view along line A-A in FIG. 10.
Figure 15:
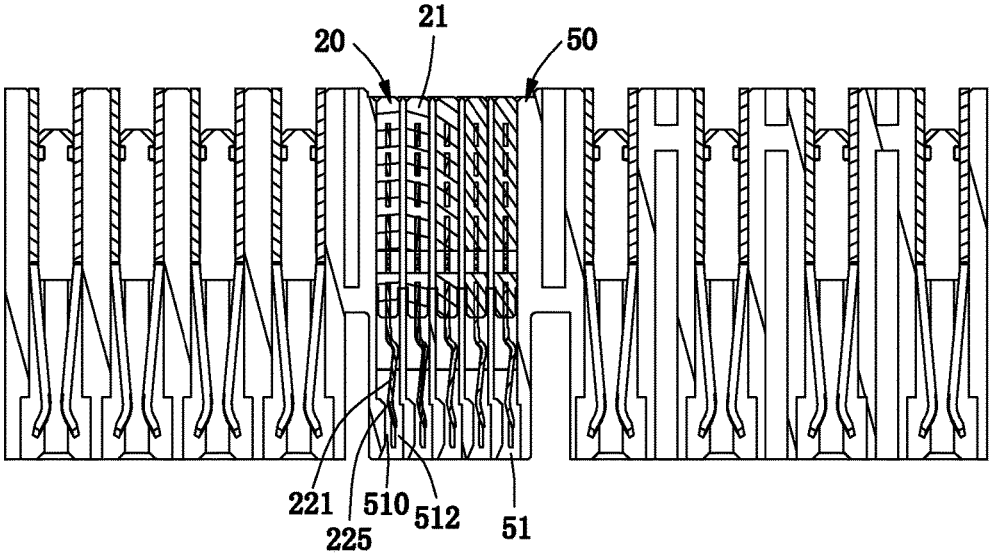
FIG. 15 is a sectional view along line B-B in FIG. 10.

Please refer to FIGS. 11, 13 and 14, when the pair of power terminals 30*a* are mounted in the power receptacle part 60, the first and second vertical plates 31, 32 are retained in the corresponding power terminal-receiving passage 62, the fronts of the first and second flexible arms 33, 34 enter into the corresponding long channels 611 of the power port 61, and the first and second convex surfaces 35, 36 are exposed in the power insertion hole 610 to be ready for being electrically engaged with the plug connector. The first power tails 37 and the second power tails 38 extend out of the bottom of the receptacle housing 10 to be ready for being electrically connection to the outside circuit board. Moreover, as shown in FIG. 14, when the pair of power terminals 30*a* are mounted in the power receptacle part 60, the first protruding portion 310 and the second protruding portion 320 can be close together and form a bridge 39 (label seen in FIG. 14), which connects the first vertical plate 31 and the second vertical plate 32 to make the pair of power terminals 30*a* be an integrated whole. The first holding portion 312 and the second holding portion 322 are pressed onto inner walls of the power terminal-receiving passage 62, whereby the pair of power terminals 30*a* can be retained in the receptacle housing 10. FIG. 13 shows only one holding portion 322 to be held on the inner wall of the power terminal-receiving passage 62 due to a view angle of FIG. 3.

Please refer to FIGS. 2 and 3, when the pair of power terminals 30*a* are mounted in the power receptacle part 60, the first and second recesses 311, 321 can be aligned with the long slot 63 to together accommodate the tie bar 40.

Figure 9:
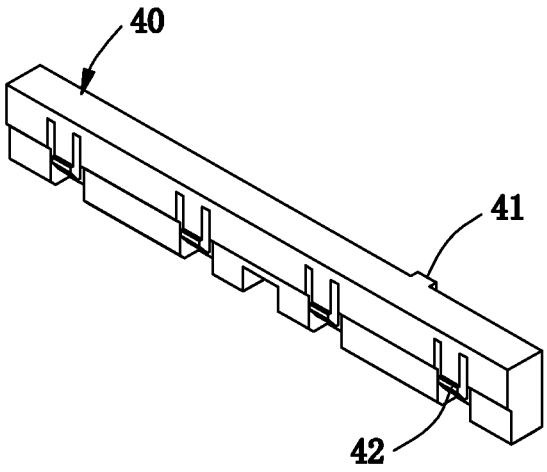
FIG. 9 is a perspective schematic view of a tie bar of the hybrid socket connector of the present invention.
Figure 10:
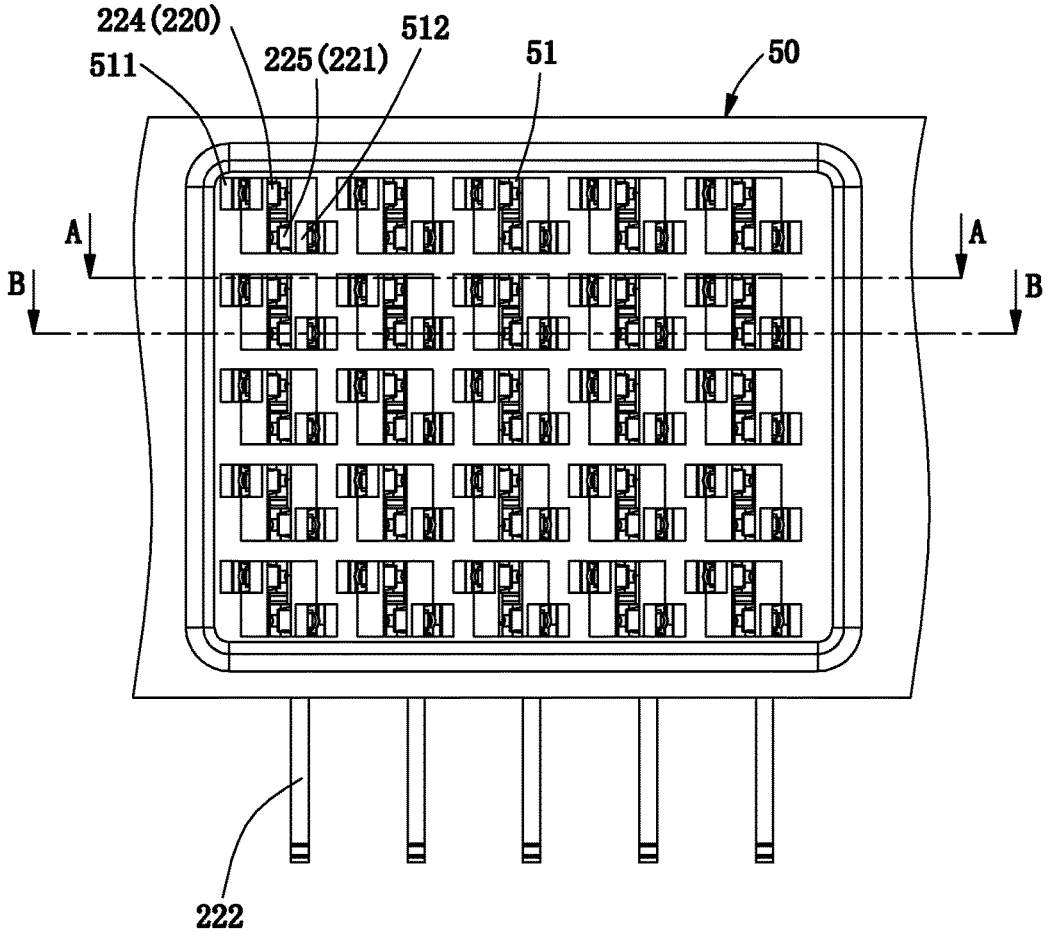
FIG. 10 is a plan view of signal ports of the hybrid socket connector of the present invention.

Please refer to FIG. 9, each tie bar 40 is used to retain these power terminals 30. The tie bar 40 has an anti-mistake bump 41 located on the front of the tie bar 40 and multiple locks 42 located on the rear thereof. Please refer to FIGS. 2, 3 and 9, when these power terminals 30 are mounted in the power receptacle part 60, the tie bar 40 is embedded into the long slot 63 and enters into the first and second recesses 311, 321 of these power terminals 30. Now, the anti-mistake bump 41 is engaged with the anti-mistake recess 630, these locks 42 are engaged with the bottoms of the corresponding vertical arms 631, whereby the tie bar 40 is fixed in the long slot 63 and these power terminals 30 are further retained in the power receptacle part 60.

As described above, the hybrid socket connector 1 of the present invention can make power supply and signal transmission functions be integrated together for ensuring integrity of the power supply and the signal transmission. Moreover, the hybrid socket connector 1 of the present invention can be reliably connected with the plug connector and has a strong structural stability by modifying the structures of the power terminals 30 and the signal terminals 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hybrid socket connector comprising:

a receptacle housing including a signal receptacle part and a power receptacle part adjacent to the signal receptacle part; the signal receptacle part having a plurality of signal ports located in the front of the signal receptacle part and arranged in multi-rows and multi-columns pattern, and a row of signal terminal-receiving passages located on the rear thereof and communicated with the corresponding signal ports; each signal port having a signal insertion hole located in the middle of the signal port, a first opening located in the upper left thereof, and a second opening located in the lower right thereof; the power receptacle part having a row of power ports located on the front of the power receptacle part, a row of power terminal-receiving passages located on the rear thereof and communicated with the corresponding power ports, and a long slot located on the top thereof and communicated with the row of power terminal-receiving passages;

a row of signal terminal assemblies being mounted in the signal receptacle part; each signal terminal assembly including an insulative frame and multiple signal terminals supported by the insulative frame; each signal terminal having at least one pair of elastic arms extending out of the front of the insulative frame, and a signal tail extending out of the bottom of the insulative frame; the pair of elastic arms consisting of a first elastic arm and a second elastic arm located below the first elastic arm; the first elastic arm and the second elastic arm being arranged in a staggered manner along a left-right direction; the first elastic arm forming a first signal contact surface on the right of the first elastic arm; the second elastic arm forming a second signal contact surface on the left of the second elastic arm; the insulative frame being retained in the corresponding signal terminal-receiving passage, the front of the first elastic arm entering into the first opening of the signal port and the first signal contact surface being exposed in the signal insertion hole; the front of the second elastic arm entering into the second opening of the signal port and the second signal contact surface being exposed in the signal insertion hole; the signal tail extending out of the bottom of the signal receptacle part;

a row of power terminals being mounted in the corresponding power terminal-receiving passages of the power receptacle part and entering into the corresponding power ports; and at least one tie bar being mounted in the long slot of the power receptacle part for retaining these power terminals.

2. The hybrid socket connector as claimed in claim 1, wherein the signal port is Z-shaped; the signal port further includes a first vertical wall separating the first opening from the signal insertion hole, and a second vertical wall separating the second opening from the signal insertion hole; and the first vertical wall and the second vertical wall are disposed on the front of the signal port.

3. The hybrid socket connector as claimed in claim 1, wherein the signal receptacle part further includes a row of retaining holes located on the top thereof and communicated with the corresponding signal terminal-receiving passages; the insulative frame has a cut formed on the top thereof and a cantilever beam located in the cut and extending backward from a front wall of the cut; the cantilever beam forms a protrusion protruding upward on the end of the cantilever beam; when the insulative frame is retained in the corresponding signal terminal-receiving passage, the cantilever beam and the protrusion enter into the retaining hole.

4. The hybrid socket connector as claimed in claim 1, wherein each power port includes a power insertion hole located in the middle of the power port, and at least two long channels symmetrically arranged on two sides of the power insertion hole and communicated with the power insertion hole.

5. The hybrid socket connector as claimed in claim 4, wherein the row of power terminals include multiple pairs of power terminals;

each pair of power terminals consist of two adjacent and symmetrical power terminals;

each pair of power terminals include a first vertical plate, a second vertical plate being parallel to and being separated from the first vertical plate, at least one first flexible arm extending forward from the front of the first vertical plate, at least one second flexible arm extending forward from the front of the second vertical plate and being symmetrical to the first flexible arm, at least one first convex surface facing the second flexible arm and being formed on the first flexible arm by bending, at least one second convex surface facing the first flexible arm and being formed on the second flexible arm by bending, multiple first power tails being formed on the bottom of the first vertical plate, and multiple second power tails being formed on the bottom of the first vertical plate; the first flexible arm and the second flexible arm together construct a clamp shape; when the pair of power terminals are mounted in the power receptacle part, the first and second vertical plates are retained in the corresponding power terminal-receiving passage, the fronts of the first and second flexible arms enter into the corresponding long channels of the power port, and the first and second convex surfaces are exposed in the power insertion hole.

6. The hybrid socket connector as claimed in claim 5, wherein the first vertical plate has a first protruding portion formed thereon and protruding toward the second vertical plate; the second vertical plate has a second protruding portion formed thereon and protruding toward the first vertical plate; the second protruding portion is symmetrical to the first protruding portion;

when the pair of power terminals are mounted in the power receptacle part, the first protruding portion and the second protruding portion are mechanically connected together and contact each other to together form a bridge connecting the first vertical plate and the second vertical plate.

7. The hybrid socket connector as claimed in claim 5, wherein the first vertical plate further has a first recess formed on the top of the first vertical plate, and the second vertical plate further has a second recess formed on the top of the second vertical plate and being symmetrical to the first recess; when the pair of power terminals are mounted in the power receptacle part, the first and second recesses are aligned with the long slot to together accommodate the tie bar.

8. The hybrid socket connector as claimed in claim 7, wherein the long slot forms an anti-mistake recess located on one sidewall of the long slot, and multiple short vertical arms located on the other sidewall thereof and being corresponding to these terminal-receiving passages;

the tie bar has an anti-mistake bump located on the front of the tie bar and multiple locks located on the rear thereof; when the tie bar is embedded into the long slot and enters into the first and second recesses, the anti-mistake bump is engaged with the anti-mistake recess, and these locks are engaged with the bottoms of the corresponding vertical arms.

9. The hybrid socket connector as claimed in claim 5, wherein the first vertical plate further has a first holding portion formed on the bottom thereof and protruding toward the second vertical plate, and the second vertical plate further has a second holding portion formed on the bottom thereof and protruding toward the first vertical plate; when the pair of power terminals are mounted in the power receptacle part, the first holding portion and the second holding portion are pressed onto inner walls of the power terminal-receiving passage.

10. The hybrid socket connector as claimed in claim 1, wherein the receptacle housing has two power receptacle parts, which are located on two sides of the signal receptacle part respectively; the row of signal terminal assemblies is located in the middle of the row of power terminals; the hybrid socket connector includes two tie bars;

each power port has six long channels symmetrically distributed on the two sides thereof; and each pair of power terminals includes three first flexible arms and three second flexible arms.

* * * * *